US005299108A

United States Patent [19]

Griffin

[11] Patent Number: 5,299,108

[45] Date of Patent: Mar. 29, 1994

[54] DISPOSABLE-TYPE FLASHLIGHT

[76] Inventor: James P. Griffin, 1216 Ash St., St. Charles, Ill. 60174

[21] Appl. No.: 5,780

[22] Filed: Jan. 19, 1993

[51] Int. Cl.[5] ..... F21L 7/00

[52] U.S. Cl. ..... 362/189; 362/208

[58] Field of Search ..... 362/157, 189, 200, 202, 362/205, 208

[56] References Cited

U.S. PATENT DOCUMENTS

| | | | |
|---|---|---|---|
| 4,443,833 | 4/1984 | Fazzina | 362/189 |
| 4,524,409 | 6/1985 | Yakubek | 362/189 |
| 4,885,666 | 12/1989 | Yu | 362/189 |
| 4,926,300 | 5/1990 | Ralston | 362/189 |
| 5,124,898 | 6/1992 | Chabria | 362/189 |

*Primary Examiner*—Richard R. Cole
*Attorney, Agent, or Firm*—John L. Schmitt

[57] ABSTRACT

A disposable-type flashlight comprises a core piece having recessed sidewalls to hold a pair of oppositely positioned batteries. These batteries and core then fit inside of a flexible, hollow case. The flashlight further includes a switch having a pair of flexible arms connected by a base segment that fits against a rear end of the core piece. A front end of each switch arm locates next to a base terminal portion of a bulb having an inner terminal end held in an opening in a front end of the core piece. The switch base segment engages a rear terminal end of one battery while an oppositely charged rear terminal end of the other battery engages a contact flange of a connector strip. This strip extends through an inner space of the core piece to engage the bulb inner terminal end. A front contact member having a flexible web connects front terminal ends of the battery with an opening in the web holding a front lens portion of the bulb. Caps fitted over ends of the case compress the various components held in place by the core piece. One operates the flashlight by squeezing the case. This action flexes the switch arms which then contact the bulb base terminal portion and close an electric circuit of the flashlight.

12 Claims, 1 Drawing Sheet

DISPOSABLE-TYPE FLASHLIGHT

BACKGROUND OF THE INVENTION

1. Field of the Invention

This invention relates generally to flashlights and more particularly to compact, disposable-type flashlights that are operated by squeezing a case of the flashlight.

2. Prior Art

Compact, disposal-type flashlights are well known and have been available for a number of years.

One early disposable-type flashlight is disclosed in U.S. Pat. No. 3,797,869. This flashlight includes a switch wire which may be pressed against an uninsulated can of one of two batteries to close an electrical circuit of the flashlight. This circuit includes a bulb having two lead wires welded respectively to a positive terminal of one battery and a negative terminal of the other battery.

U.S. Pat. No. 4,429,352 discloses the first inventive flashlight of the inventor of a herein disclosed still further improved lighting instrument. The bulb of this flashlight also has two lead wires. A first lead wire is attached by a solder joint to a positive front terminal end of one battery while the second lead wire functions as a switch. Compression of a case of the flashlight bends the second lead wire to engage a connector strap and close a circuit of the flashlight to energize the bulb.

A second inventive flashlight from this inventor is set out in U.S. Pat. No. 4,819,140. In this flashlight one of the two bulb lead wires is bent forward over the bulb. Compression of the flashlight case presses one arm of a U-shaped spring switch into contact with this forward bent lead wire to close a circuit on the flashlight and connect the batteries with the bulb.

SUMMARY OF THE INVENTION

A still further improved disposable-type flashlight of this invention includes a hollow, pliable case. Carried in the case is a hollow core piece that holds a pair of oppositely positioned batteries against an inner wall of the case. Connecting oppositely charged front terminal ends of the batteries is a conductive front contact member having a hat-like shape. A front lens of a bulb of the instrument is contained in an opening in a web of the front contact member. An inner terminal end of the bulb then is carried in a front end opening of the core piece.

A base segment of a conductive switch fits against a rear end of the core piece to engage a rear terminal end of one battery. The switch base segment connects spaced apart, flexible arms that extend forward so that an end tip of each arm locates adjacent to a base terminal portion of the bulb.

A flange of a conductive connector strip is positioned opposite the switch base segment to engage a rear terminal end of the other battery. The strip then extends forward into an inner space of the core piece where a flexible end of the strip engages the bulb inner terminal end.

To complete assembly of the flashlight caps are placed over a front and rear end of the case with the bulb lens end extending outward from an opening in the front end cap. As affixed to the case, the caps compress the various components therein. This compressive force produces a slight flexing of the front contact member and the connector strip.

To operate the flashlight one squeezes the case forcing the end tip of either switch arm against the bulb base terminal portion. The resulting engagement closes an electric circuit comprising the bulb, batteries, front contact member, switch, and connector strip. Current from the batteries flows to energize the bulb and produce illumination.

The flashlight of this most recent invention provides several improvements not known or presently available in other disposable-type flashlights.

To appreciate these improvements and resulting advantages, one must understand that for a disposal-type flashlight to be commercially successful, that flashlight must operate reliably and be competitively priced. These criteria in turn require an availability of high quality components in large quantities.

A first advantage of this improved flashlight is that large quantities of high quality components for this flashlight may be mass-produced at a reasonable cost.

A second advantage is that these components then may be quickly assembled into reliably working flashlights. Of particular importance to promoting reliability is that the bulb of this flashlight does not have lead wires, common to most other available assemblies. Typically, bulb lead wires are connected to other circuit components by a solder joint. Such joints are subject to failure because of their inherent structural weakness. Additionally, bulb lead wires have been known to break or become dislocated and cause a short circuit. Further, any excessive heat used to form a solder joint can be detrimental to the batteries.

In this inventive flashlight all of the circuit components first are positively located and then connections between these components are held together by a continuing compressive force. Resulting friction produces high-quality conductive interfaces. This continuing compressive force results from a flexing of the front contact member and connector strip. The spring-like nature of these components also accommodates dimensional variations of the batteries and the bulb. The bulb and batteries are staple-like purchased components; as such, they are not manufactured to exacting dimensional tolerances.

Reliability is further advanced by component symmetry. Components may be in a flip or flopped position for assembly. No component has just one usable position. For example, neither the core piece nor the switch has a defined top or bottom side. The front contact member has no defined right or left side. While the batteries must be positioned in an opposing manner, the batteries are identical and interchangeable. Further, the position of the switch end segment and the connector strip flange with respect to the core piece may be reversed. This invertibility and reversibility reduces the time of assembly and minimizes assembly error.

Ease of assembly is further advanced by the core piece. The core piece positively holds the switch and connector strip and helps position the bulb and batteries. As secured to the core piece, these components then may be readily inserted into the case. The core piece then maintains the position of these components within the case as discussed above.

A still further advantage is that this inventive flashlight is easy to operate. The length of the switch arms allows the case to be squeezed almost anywhere with lesser force to activate the flashlight.

DESCRIPTION OF THE PREFERRED EMBODIMENT

Figures 1, 2, 3, 4, 5, 6:
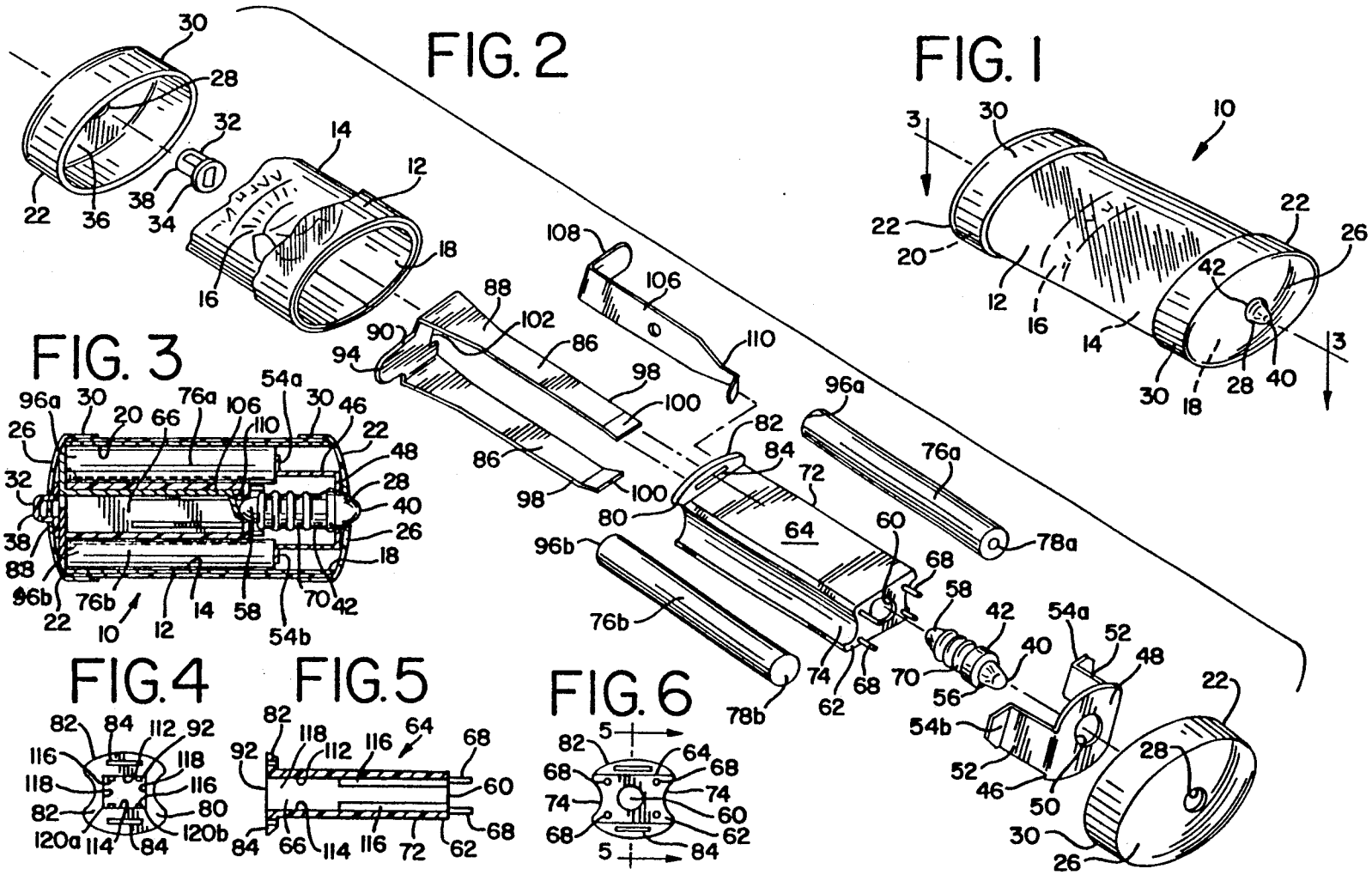
FIG. 1 is a perspective view of a flashlight of this invention.
FIG. 2 is an exploded view in perspective of components of the flashlight of FIG. 1.
FIG. 3 is a cross sectional view of the flashlight as seen generally along the line 3—3 of FIG. 1.
FIG. 4 is an elevation view of a rear end of a core piece of the flashlight.
FIG. 5 is a side elevation view in cross section of the core piece as seen generally along the line 5—5 of FIG. 6.
FIG. 6 is an elevation view of a front end of the core piece.

A flashlight of this invention is shown generally in FIG. 1 and designated 10. The flashlight 10 includes a hollow, oval-like shaped case 12. This case 12 is made of a thin, pliable plastic material which preferably is translucent. When the case 12 is translucent, a paper lining 14 may be carried snugly in the case 12 so that advertising indicia 16 printed on the paper liner 14 is visible therein.

Fitted over a front end 18 and a rear end 20 of the case 12 is a respective cap 22. In an end wall 26 of each cap 22 is an opening 28. A peripheral sidewall 30 then extends inward from each cap end wall 26 to fit tightly about the front end 18 and the rear end 20 of the case 12.

In the opening 28 of the rear end cap 22 is a key ring holder 32 having an inner end flange 34 that abuts against an inside surface 36 of the cap end wall 26. A slotted outer end 38 of the holder 32 then extends from the opening 26. Projecting through the opening 28 of the front end cap 22 is an outer lens end 40 of a bulb 42. This bulb 42 has a 2.5 volt rating.

Interior structure of the flashlight 10 can best be understood by viewing FIGS. 2–6. Inside the front end cap 22 is a hat-like shaped front contact member 46. This contact member 46 is made of a flexible, conductive material and includes a web 48 formed with an opening 50. The web 48 connects a pair of spaced apart legs 52 positioned on an angle so that the legs 52 flare slightly apart. On the end of each leg 52 is a respective contact flange 54*a*, 54*b* positioned on a slight angle to flare away from the web 48. The bulb lens end 40 extends through the contact member web opening 50 with a shoulder 56 of the bulb 42 fitting against the web 48.

As shown in FIGS. 2 and 3, an inner terminal end 58 of the bulb 42 is carried in an opening 60 in a front end 62 of a core piece 64. As located, the bulb inner terminal end 58 locates in a rectangular-shaped, hollow inner space 66 of the core piece 64. Projecting forward from the core piece front end 62 and positioned about the opening 60 is a set of four posts 68 which fit about a terminal base portion 70 of the bulb 42. These posts 68 help secure the bulb 42 during assembly of the flashlight 10 and then inhibit any inadvertent contact between the bulb base terminal portion 70 and the front contact member 46.

The core piece 64, see FIGS. 2 and 4–6, has an elongated body 72 formed with recessed sidewalls 74 sized to hold respectively a pair of quad-A, alkaline batteries 76*a*, 76*b*. Each battery 76*a*, 76*b* has a 1.5 volt rating. Additionally, the core piece sidewalls 74 are spaced apart to locate the batteries 76*a*, 76*b* firmly against the paper liner 14 inside the case 12. The batteries 76*a*, 76*b* are positioned in an opposing manner so that, for example, a front terminal end 78*a* of the battery 76*a* is positively charged while a front terminal end 78*b* of the battery 76*b* is negatively charged, see FIG. 2.

A rear end 80 of the core piece 64 has a top and bottom flange 82. In each flange 82 is a slot 84 to hold respective arms 86 of a switch 88. The switch 88 is made of a flexible, conductive material with the arms 88 connected by a base segment 90. This base segment 90 fits against the core piece rear end 80 to in part cover an rear end opening 92 to the core piece inner space 66. A contact extension 94 of the segment 90 then engages a rear terminal end 96*b* of the battery 76*b*.

The switch arms 86 extend forward and outward on an angle. This angle is such that a forward end portion 98 of each arm 86 is flexed inward by contact with the case 12 at a point near the front end 62 of the core piece 64. Each arm 86 then has an inwardly offset contact tip end 100 that locate near and on each side the bulb terminal base portion 70.

The switch base segment 90 has a notch 102 opposite the contact extension 94, see FIG. 2. A connector strip 106 extends through this notch 102 and the core piece rear end opening 92 and into the core piece inner space 66. This strip 106, also made of a flexible, conductive material, has a rear end contact flange 108 that engages a rear terminal end 96*a* of the battery 76*a*. A front end portion 110 of the connector strip 106 has a narrowed width and is offset on an angle to engage the inner terminal end 58 of the bulb 42.

To locate the connector strip 106 within the core piece inner space 66, a top and a bottom wall 112, 114 of the inner space 66 each has a set of ribs 116, see FIG. 4. Each rib set 116 is spaced inward from respective sidewalls 118 of the core piece inner space 66 to form glide slots 120*a*, 120*b*. As shown, the connector strip 106 is located in the glide slot 120*a*.

The caps 22 are affixed to the case ends 18, 20 to apply a slight compressive force to various connections between elements comprising an electric circuit of the flashlight 10. For example, the caps 22 force the switch base segment 90, connector strip contact flange 108, batteries 76*a*, 76*b*, and flanges contacts 54*a*, 54*b* of the front contact member 46 together. Because the flange contacts 54*a*, 54*b* are on a slight angle, this force flexes the legs 52 of each contact flange 54*a*, 54*b* slightly apart. This flexing of the legs 52 produces a reactive force which then maintains the connections between these components is a compressive state.

In a like manner the caps 22 force the connector strip 106, bulb 42, and front contact member web 48 together. Force applied to this second element grouping flexes the connector strip front end portion 110 and the front contact member web 48. This further flexing then maintains connections between these components in a like compressive state. The core piece 64 and the case 12 inhibit component dislocation induced by this compressive state.

Upon assembly the flashlight 10 is operated by compressing the case 12. Compression of the case 12 presses the switch arms 86 inward so that at least one arm contact tip 100 engages the bulb terminal base portion 70. This engagement in turn closes the circuit of the flashlight 10 so that electric current may flow from the batteries 76*a*, 76*b* to the bulb 42. The now energized bulb 42 produces illumination.

While an embodiment, uses and advantages of this invention have been shown and discussed, it should be understood that this invention is limited only by the scope of the claims. Those skilled in the art will appreciate that various modifications or changes may be made without departing from the scope and spirit of the invention, and these modifications and changes may result in further uses and advantages.

What I claim is:

1. In a disposable-type flashlight having an electrical circuit including a pair of batteries, a bulb, a switch, a contact member, and a connector strip, an improvement therein comprising:

a core piece having a guide slot formed in an inner space of said piece and a set of spaced apart, slotted flanges formed on a rear end of said piece, wherein said connector strip is carried in said guide slot and said switch is carried in said flange slots during assembly of said flashlight and then positively located by such during operation of said flashlight.

2. A disposable-type flashlight as defined by claim 1 and further characterized by, said core piece having an opening to said inner space in a front end to hold an inner terminal end of said bulb and a set of posts positioned about said front end opening, wherein a front end portion of said connector strip engages said bulb inner terminal end, and said post set in part holds said bulb during said assembly of said flashlight.

3. A disposable-type flashlight as defined by claim 1 and further characterized by, said core piece guild slot defined a sidewall of said core piece inner space and ribs spaced inward therefrom.

4. A disposable-type flashlight as defined by claim 1 and further characterized by, said core piece inner space having a pair of said guide slots, wherein said connector strip is placeable in either said slot.

5. A disposable-type flashlight comprising:

a hollow, flexible case, a core piece carried in said case with said core piece having a front end and a rear end formed with openings to an inner space, a bulb having an inner terminal end positioned in said core piece front end opening, a front contact member made of a flexible, conductive material and having a web with an opening to secure a lens end of said bulb and connecting spaced apart legs formed with respective contact flanges, a pair of spaced apart batteries carried respectively in sidewall recesses of said core piece to fit snugly inside said case, said batteries positioned so that a positive front terminal end of one said battery engages one said front contact member flange and a negative front terminal end of said other battery engages said other front contact member flange, a switch made of a flexible, conductive material and having a base segment fitting against said core piece rear end with said base segment having a contact extension engaging a rear terminal end of one said battery, said base segment connecting a pair of spaced apart flexible arms positioned above and below said core piece with each said arm having an end tip located near a base terminal portion of said bulb, and a connector strip made of a conductive, flexible material, said strip carried in said core piece inner space and having a front end portion engaging said bulb inner terminal end and a rear end contact flange extending outward from said core piece rear end opening on a side opposite said switch base segment contact extension to engage a rear terminal end of said other battery, wherein ends of said case are covered by caps positioned to engage and compress said front contact member and said connector strip and flex such, said flexing maintaining a compressive state between front contact member and said battery front terminal ends, between said switch base segment, said connector strip contact flange and said battery rear terminal ends, and between said connector strip front end portion and said bulb inner terminal end, and said compressive state promoting electrical continuity between circuit components so that said flashlight operates in a highly reliable manner.

6. A disposable-type flashlight as defined in claim 5 and further characterized by said core piece including, ribs in said core piece inner space to form a guide slot to hold said connector strip and prevent contact between said connector strip and said switch, a top and bottom flange formed on said rear end of said core piece with slots to hold said switch arms, and a set of posts on said front end of said core piece with said posts spaced about said front end opening and said bulb, wherein to facilitate assembly said connector strip and said switch are affixed to said core piece and said bulb positioned on said core piece before said core piece is inserted into said case.

7. A disposable-type flashlight as defined by claim 6 and further characterized by, said core piece inner space having a top wall and a bottom wall each formed with one set of said ribs to define a pair of guide slots, wherein during assembly said core piece is usable in an upright or an inverted position.

8. A disposable-type flashlight as defined by claim 5 and further characterized by, said connector strip front end portion being narrowed and offset, wherein said compressive force applied by said caps flexes said strip front end portion.

9. A disposable-type flashlight as defined by claim 5 and further characterized by, said switch having a notch formed in said base segment on a side opposite said contact extension, wherein said notch provides access to said core piece rear end opening for insertion of said connector strip into said core piece inner space.

10. A disposable-type flashlight as defined by claim 5 and further characterized by, said batteries being quad-A, 1.5 volt alkaline-type.

11. A disposable-type flashlight having an electric circuit comprising:

battery means including a first and a second battery to provide electric current, bulb means to supply illumination upon being energized by said electric current, switch means having a pair of flexible arm selectively compressible to engage a base terminal portion of said bulb means and a base segment to engage a rear terminal end of said first battery for transferring said electric current between said first battery rear end terminal and said bulb means base terminal, contact member means engaging a front terminal end of said first and said second battery for transferring said electric current therebetween and to hold said bulb means, said front contact means allowing selective movement of said batteries and said bulb means in response to an applied compressive force, and connector strip means having a flange to engage a rear terminal end of said second battery and a flexible front end portion to engage an inner terminal end of said bulb means for transferring said electric current therebetween, said connector strip means front portion allowing selective movement of said bulb means in response to said compressive force, wherein to promote highly reliable operation of said circuit components during use of said flashlight, said components are located within a flexible case by a core piece, caps fitting over ends of said case induce said compressive force and produce said movements and flexing said front contact member means and said connector strip means, and said case then squeezed to press said arms of said switch means into engagement with said bulb means base terminal to close said circuit allowing said electric current to flow from said batteries means to said bulb means and illuminate such.

12. In a disposable-type flashlight including operative components comprising a pair of batteries, a bulb, a switch, and connective means to join said batteries, said bulb, and said switch into an electrical circuit and inoperative components comprising a core piece to carry said operative components and a flexible case to carry said operative and inoperative components, an improvement therein comprising:

said switch defined a pair of spaced apart arms connected by a base segment having a contact extension, said switch base segment fitting on a rear end of said core piece with said contact extension engaging a rear terminal end of one said battery and said switch arms extending forward on respective sides of said core piece toward a front end of said case, wherein compression of said case may move at least one said switch arm inward to close and energize said circuit.

* * * * *